US007988795B2

(12) United States Patent
Hirota et al.

(10) Patent No.: US 7,988,795 B2
(45) Date of Patent: Aug. 2, 2011

(54) R-T-B—C RARE EARTH SINTERED MAGNET AND MAKING METHOD

(75) Inventors: Koichi Hirota, Echizen (JP); Takehisa Minowa, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 715 days.

(21) Appl. No.: 11/606,088

(22) Filed: Nov. 30, 2006

(65) Prior Publication Data

US 2007/0125452 A1 Jun. 7, 2007

(30) Foreign Application Priority Data

Dec. 2, 2005 (JP) ..... 2005-349185
Dec. 2, 2005 (JP) ..... 2005-349192

(51) Int. Cl.
*H01F 1/057* (2006.01)

(52) U.S. Cl. ..... 148/103; 148/101; 148/302

(58) Field of Classification Search ..... None
See application file for complete search history.

(56) References Cited

U.S. PATENT DOCUMENTS

| | | | | |
|---|---|---|---|---|
| 5,858,124 | A | 1/1999 | Endo et al. | |
| 7,485,193 | B2 | 2/2009 | Hirota et al. | |
| 2005/0081959 | A1 | 4/2005 | Kim et al. | |
| 2006/0213583 | A1* | 9/2006 | Nakamura et al. | 148/302 |
| 2006/0213585 | A1* | 9/2006 | Nakamura et al. | 148/302 |
| 2006/0222848 | A1* | 10/2006 | Satsu et al. | 428/403 |
| 2007/0071979 | A1* | 3/2007 | Komuro et al. | 428/403 |
| 2008/0245442 | A1* | 10/2008 | Nakamura et al. | 148/101 |

FOREIGN PATENT DOCUMENTS

| | | | |
|---|---|---|---|
| EP | 0 286 357 | A2 | 10/1988 |
| EP | 0 994 493 | A2 | 4/2000 |
| JP | 62-171102 | A | 7/1987 |
| JP | 63-255902 | | 10/1988 |
| JP | 6-244011 | A | 9/1994 |
| JP | 9-186010 | A | 7/1997 |
| JP | 10-163055 | A | 6/1998 |
| JP | 2001-68317 | A | 3/2001 |
| JP | 2001-230107 | A | 8/2001 |
| JP | 2002-64010 | A | 2/2002 |
| JP | 2003-22905 | A | 1/2003 |

(Continued)

OTHER PUBLICATIONS

Machine Translation of Japanese Patent Document No. 2003-022905.*

(Continued)

*Primary Examiner* — John P Sheehan
(74) *Attorney, Agent, or Firm* — Birch, Stewart, Kolasch & Birch, LLP

(57) ABSTRACT

An R-T-B—C rare earth sintered magnet (R=Ce, Pr, Nd, Tb, or Dy; T=Fe) is obtained by mixing an R-T-B—C magnet matrix alloy with an R fluoride and an R-rich R-T-B—C sintering aid alloy, followed by pulverization, compaction and sintering. The sintered structure consists of an $R_2T_{14}B$ type crystal primary phase and a grain boundary phase. The grain boundary phase consists essentially of 40-98 vol % of $R—O_{1-x}—F_{1+2x}$ and/or $R—F_y$, 1-50 vol % of R—O, R—O—C or R—C compound phase, 0.05-10 vol % of R-T phase, 0.05-20 vol % of B-rich phase or $M-B_2$ phase (M=Ti, V, Cr, Zr, Nb, Mo, Hf, Ta or W), and the balance of an R-rich phase.

9 Claims, 2 Drawing Sheets

FOREIGN PATENT DOCUMENTS

| | | | |
|---|---|---|---|
| JP | 2003-70214 | A | 3/2003 |
| JP | 2003-282312 | A | 10/2003 |

OTHER PUBLICATIONS

Machine Translation of Japanese Patent Document No. 2003-282312.*

Japanese Office Action issued on Apr. 28, 2010 in corresponding Japanese Patent Application No. 2005-349185.

Japanese Office Action issued on Apr. 28, 2010 in corresponding Japanese Patent Application No. 2005-349192.

Extended European Search Report issued on Jun. 25, 2008 in European Patent Application No. 06 25 6182.

* cited by examiner

R-T-B—C RARE EARTH SINTERED MAGNET AND MAKING METHOD

CROSS-REFERENCE TO RELATED APPLICATION

This non-provisional application claims priority under 35 U.S.C. §119(a) on Patent Application Nos. 2005-349185 and 2005-349192 filed in Japan on Dec. 2, 2005, and Dec. 2, 2005, respectively, the entire contents of which are hereby incorporated by reference.

TECHNICAL FIELD

This invention relates to an R-T-B—C rare earth sintered magnet and a method of preparing the same. More particularly, it relates to an R-T-B—C rare earth sintered magnet which has improved magnetic characteristics including suppression of heat generation due to eddy current in varying magnetic fields and a reduced loss and is useful in industrial fields of motors, electronic parts, and electric equipment.

BACKGROUND ART

Rare earth magnet manufacturers have continued consecutive improvements in composition and development of more efficient preparation methods. Nowadays, it becomes possible to produce high-performance magnets having a (BH) max of 50 MGOe or greater and a coercive force of 30 kOe or greater. They are used in a wider variety of applications including not only parts in consumer appliances and computer-related equipment such as voice coil motors (VCM) and pickup sensors for CD and DVD, and medical equipment like MRI as often found in the past, but also electric and electronic parts such as motors and sensors.

In the case of permanent magnet motors, for example, economical ferrite magnets were used in the past, but have been increasingly replaced by rare earth magnets to meet the current demand for motors with reduced size and increased efficiency. The rare earth magnets on general use include Sm—Co magnets and Nd—Fe—B magnets. The Sm—Co magnets experience little changes with temperature of magnetic properties due to high Curie temperature, and eliminate a need for surface treatment due to corrosion resistance. However, they are very expensive because of their composition with a high cobalt content. On the other hand, the Nd—Fe—B magnets have the highest saturation magnetization among permanent magnets and are inexpensive because the major component is inexpensive iron. The Nd—Fe—B magnets, however, experience substantial changes with temperature of magnetic properties due to low Curie temperature, and lack heat resistance. Since they also have poor corrosion resistance, an appropriate surface treatment must be carried out in a certain application.

Rare earth magnets have a resistivity of about 150 μΩ-cm which is lower by two orders than that of ferrite magnets. Therefore, a problem arises when rare earth magnets are used in motors. Since a varying magnetic field is applied across the magnet, eddy current is created by electromagnetic induction. By the Joule heat due to eddy current flow, the permanent magnet generates heat. As the temperature of permanent magnet is elevated, magnetic properties degrade, particularly in the case of Nd—Fe—B sintered magnets having noticeable changes with temperature of magnetic properties. As a result, the efficiency of the motor deteriorates. This deterioration is referred to as eddy current loss.

There have been considered and proposed several countermeasures against such deterioration including (1) to increase the coercive force of a magnet, (2) to divide a magnet into segments in a magnetization direction, (3) to provide an insulating layer within the magnet interior, and (4) to increase the resistivity of a magnet.

In method (1), heavy rare earth elements such as Dy substitute for part of Nd—Fe—B to enhance the magnetocrystalline anisotropy and coercive force. The heavy rare earth elements used for partial substitution are short in resource and expensive. Undesirably, this eventually increases the cost of magnet unit.

In method (2) of dividing a magnet into segments, the heat value generated is controlled by reducing the area across which the magnetic flux penetrates or by optimizing the aspect ratio of the area across which the magnetic flux penetrates. The heat value can be further reduced by increasing the number of divisions, which undesirably increases the manufacturing cost.

Method (3) is effective when the external magnetic field varies parallel to the magnetization direction of the magnet, but not effective in actual motors where the varying direction of the external magnetic field is not fixed.

In method (4), the resistivity of a magnet at room temperature is increased by adding an insulating phase. Depending on a particular insulating material selected, densification is difficult, so that magnetic properties and corrosion resistance are deteriorated. A special sintering technique must be employed for achieving densification.

Reference should be made to JP-A 2003-070214, JP-A 2001-068317, JP-A 2002-064010, JP-A 10-163055, and JP-A 2003-022905.

DISCLOSURE OF THE INVENTION

An object of the present invention is to provide an R-T-B—C rare earth sintered magnet which has improved magnetic characteristics including suppression of heat generation due to eddy current in varying magnetic fields and a reduced loss, and a method for preparing the same.

The inventors have found that an R-T-B—C rare earth sintered magnet (wherein R is at least one rare earth element selected from the group consisting of Ce, Pr, Nd, Tb and Dy, T is iron or a mixture of iron and at least one other transition metal, B is boron, and C is carbon) to be described below is effective for solving the above-described problems because it has a high coercive force, a high resistivity enough to control eddy current generation, and a great temperature coefficient of resistivity.

It has also been found that the R-T-B—C low-loss sintered magnet can be prepared by mixing (II) an R-rich R-T-B—C sintering aid alloy, (III) an R—$O_{1-x}$—$F_{1+2x}$ and/or R—$F_y$ powder, and (I) an R-T-B—C primary phase magnet matrix alloy powder in proper amounts, and pulverizing the mixture through a jet mill in a nitrogen stream, whereby R-rich R-T-B—C sintering aid alloy powder (II) and R—$O_{1-x}$—$F_{1+2x}$ and/or R—$F_y$ powder (III) are finely dispersed.

In a first aspect, the invention provides an R-T-B—C rare earth sintered magnet wherein R is at least one rare earth element selected from the group consisting of Ce, Pr, Nd, Tb, and Dy, T is iron or a mixture of iron and at least one other transition metal, B is boron, and C is carbon, which magnet is obtained by mixing an R-T-B—C magnet matrix alloy with an R-rich R-T-B—C sintering aid alloy, followed by pulverization, compaction and sintering. The rare earth sintered magnet has a sintered structure consisting of an $R_2T_{14}B$ type crystal primary phase and a grain boundary phase. The grain boundary phase consists essentially of 40 to 98% by volume (a volume fraction in the grain boundary phase) of R—$O_{1-x}$—$F_{1+2x}$ and/or R—$F_y$ wherein x is an arbitrary real number of 0 to 1 and y is 2 or 3, 1 to 50% by volume of a compound phase selected from R—O, R—O—C, and R—C compounds, and mixtures thereof, 0.05 to 10% by volume of a R-T phase, 0.05 to 20% by volume of a B-rich phase ($R_{1+\epsilon}Fe_4B_4$) or M-$B_2$ phase wherein M is at least one element selected from the group consisting of Ti, V, Cr, Zr, Nb, Mo, Hf, Ta and W, and the balance of an R-rich phase.

It is preferred that in the grain boundary phase, the R—$O_{1-x}$—$F_{1+2x}$ or R—$F_y$ have a particle size of 0.1 to 50 μm, and the compound phase, the R-T phase, and the B-rich phase or M-$B_2$ phase each have a particle size of 0.05 to 20 μm. In preferred embodiments, the sintered magnet has a resistivity of at least $2.0\times10^2$ μΩ-cm at 20° C., a temperature coefficient of resistivity of at least $5.0\times10^{-2}$ μΩ-cm/° C. in a temperature region equal to or lower than the Curie point, and a specific heat of at least 400 J/kg-K.

In a second aspect, the invention provides a method for preparing a R-T-B—C sintered magnet wherein R is at least one rare earth element selected from the group consisting of Ce, Pr, Nd, Tb, and Dy, T is iron or a mixture of iron and at least one other transition metal, B is boron, and C is carbon, the method comprising the steps of mixing (II) 1 to 20% by weight of an R-rich R-T-B—C sintering aid alloy consisting essentially of 50 wt %≦R≦65 wt %, 0.3 wt %≦B≦0.9 wt %, 0.01 wt %≦C≦0.5 wt %, 0.1 wt %≦Al≦1.0 wt %, 0.1 wt %≦Cu≦5.0 wt %, and the balance of T, (III) 10 to 50% by weight of an R—$O_{1-x}$—$F_{1+2x}$ and/or R—$F_y$ powder wherein x is an arbitrary real number of 0 to 1 and y is 2 or 3, and (I) the remainder of a R-T-B—C primary phase magnet matrix alloy powder consisting essentially of 25 wt %≦R≦35 wt %, 0.8 wt %≦B≦1.4 wt %, 0.01 wt %≦C≦0.5 wt %, 0.1 wt %≦Al≦1.0 wt %, and the balance of T; pulverizing the mixture through a jet mill in a nitrogen stream; compacting the mixture in a magnetic field; sintering and heat treating the compact.

It is preferred that the R—$O_{1-x}$—$F_{1+2x}$ and/or R—$F_y$ powder has an average particle size of 0.5 to 50 μm. In one preferred embodiment, the pulverizing step includes pulverizing the mixture through a jet mill in a nitrogen stream to an average particle size of 0.01 to 30 μm, the compacting step includes compacting the mixture in a magnetic field of 800 to 1,760 kA/m under a pressure of 90 to 150 MPa, the sintering step includes sintering the compact at 1,000 to 1,200° C. in vacuum, and the heat treating step includes aging treatment at 400 to 600° C. in an argon atmosphere.

BENEFITS OF THE INVENTION

According to the invention, a sintered magnet having a high coercive force, a high resistivity sufficient to control eddy current generation under service conditions where the magnet is exposed to an alternating magnetic field as in motors, and a great temperature coefficient of resistivity can be manufactured at a low cost using the existing apparatus. There is thus available an R-T-B—C low-loss sintered magnet featuring a high resistivity and controlled eddy current generation.

The method of the invention is suited in the manufacture of a low-loss sintered magnet having a resistivity of at least 180 μΩ-cm, especially at least 250 μΩ-cm at no sacrifice of magnet properties. More specifically, the method of the invention is suited in the manufacture of a low-loss sintered magnet having a coercive force of at least 1,500 kA/m, a squareness ratio of at least 0.92, and a resistivity in the range of 250 to 450 μΩ-cm.

DESCRIPTION OF THE PREFERRED EMBODIMENT

Figure 1:
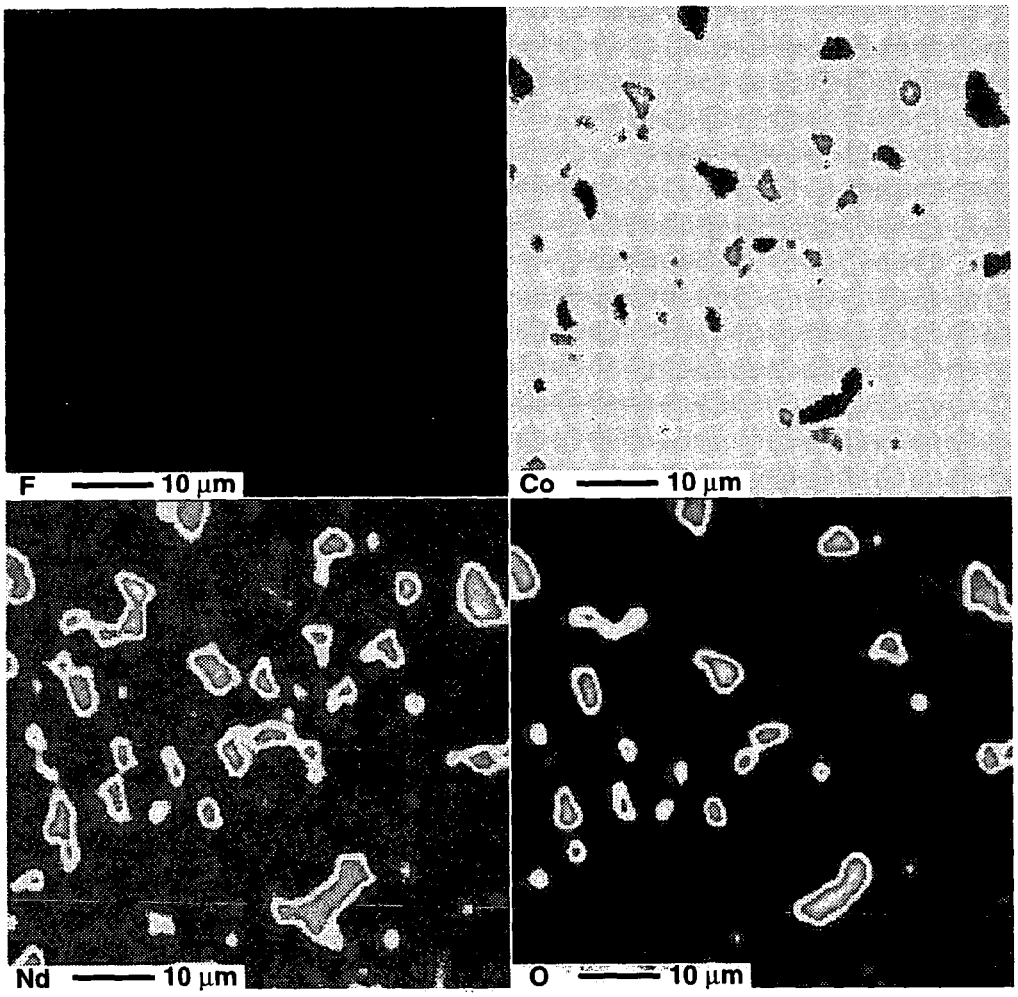
FIG. 1 illustrates back-scattered electron and MAP images of the permanent magnet material of Comparative Example 1 observed by EPMA.

The invention relates to an R-T-B—C rare earth sintered magnet wherein R is at least one rare earth element selected from the group consisting of Ce, Pr, Nd, Tb, and Dy, T is iron or a mixture of iron and at least one other transition metal, B is boron, and C is carbon. The rare earth sintered magnet has a sintered structure consisting of an $R_2T_{14}B$ type crystal primary phase and a grain boundary phase. The grain boundary is composed of R—$O_{1-x}$—$F_{1+2x}$ and/or R—$F_y$ wherein x is an arbitrary real number of 0 to 1 and y is 2 or 3, and the remainder of the grain boundary phase consists of (i) a compound phase selected from R—O, R—O—C, and R—C compounds, and mixtures thereof, (ii) a R-T phase as typified by NdCo alloy, (iii) a B-rich phase ($R_{1+\epsilon}Fe_4B_4$) or M-$B_2$ phase wherein M is at least one element selected from the group consisting of Ti, V, Cr, Zr, Nb, Mo, Hf, Ta and W, and (iv) an R-rich phase.

R—$O_{1-x}$—$F_{1+2x}$ wherein x is an arbitrary real number of 0 to 1 or R—$F_y$ wherein y is 2 or 3 has a lower melting point than rare earth oxides and does not interfere with densification. Although rare earth oxides can react with a small amount of water to form hydroxides which cause disintegration of the magnet, the phase of R—$O_{1-x}$—$F_{1+2x}$ or R—$F_y$ is more stable than the rare earth oxides and does not degrade the corrosion resistance of the magnet. R—$O_{1-x}$—$F_{1+2x}$ and R—$F_y$ account for 40 to 98% by volume, more preferably 40 to 70% by volume of the grain boundary. Less than 40% by volume of R—$O_{1-x}$—$F_{1+2x}$ and R—$F_y$ exerts less the resistivity-increasing effect. It is impossible in practice to increase the content beyond 98% by volume, because there are present an R-T intermetallic compound resulting from the R-rich R-T-B—C sintering aid alloy, and a compound phase selected from R—O, R—O—C and R—C compounds, and mixtures thereof, in the raw material or formed inevitably during the manufacturing process.

The compound phase (i) selected from R—O, R—O—C, and R—C compounds, and mixtures thereof precipitates as a result of oxygen and carbon in the raw material or incidentally introduced during the magnet manufacturing process reacting with rare earth elements having a high affinity thereto. Although these phases form R—$O_{1-x}$—$F_{1+2x}$ upon physical contact with R—$O_{1-x}$—$F_{1+2x}$ or R—$F_y$ so that they are stabilized, they are present because some are left unreacted. It is preferred that the volume fraction of compound phase (i) is as low as possible. Specifically the volume fraction of compound phase (i) is up to 50% by volume, preferably up to 25% by volume, and more preferably up to 10% by volume. More than 50% by volume is undesired because magnetic properties and corrosion resistance are deteriorated. The lower limit of its volume fraction is usually 1% by volume.

The R-T phase (ii), B-rich phase or M-$B_2$ phase (iii), and R-rich phase (iv) are indispensable for safe operation of a mass scale manufacturing process. The volume fractions of R-T phase (ii), B-rich phase or $M\text{-}B_2$ phase (iii), and R-rich phase (iv) are 0.05 to 10% by volume, 0.05 to 20% by volume, and the balance, respectively, and preferably 0.5 to 3% by volume, 0.5 to 10% by volume, and 10 to 50% by volume, respectively.

The R-T-B—C rare earth sintered magnet of the invention is manufactured by mixing an R-T-B—C magnet matrix alloy with an R-rich R-T-B—C sintering aid alloy, pulverization, compaction and sintering, more specifically by mixing (II) 1 to 20% by weight of an R-rich R-T-B—C sintering aid alloy consisting essentially of 50 wt %≦R≦65 wt %, 0.3 wt %≦B≦0.9 wt %, 0.01 wt %≦C≦0.5 wt %, 0.1 wt %≦Al≦1.0 wt %, 0.1 wt %≦Cu≦5.0 wt % (preferably 0.1 wt %≦Cu≦1.0 wt %), and the balance of T, (III) 10 to 50% by weight of an $R\text{—}O_{1-x}\text{—}F_{1+2x}$ and/or $R\text{—}F_y$ powder wherein x is an arbitrary real number of 0 to 1 and y is 2 or 3, and (I) the remainder of an R-T-B—C primary phase magnet matrix alloy powder consisting essentially of 25 wt %≦R≦35 wt %, 0.8 wt %≦B≦1.4 wt %, 0.01 wt %≦C≦0.5 wt %, 0.1 wt %≦Al≦1.0 wt %, and the balance of T, pulverizing the mixture through a jet mill in a nitrogen stream, compaction in a magnetic field, sintering, and heat treatment as will be described later. By adding the R-rich R-T-B—C sintering aid alloy (II) to the R-T-B—C primary phase magnet matrix alloy powder (I) at the same time as the rare earth fluoride and/or rare earth oxyfluoride (III), the quantity of liquid phase available during sintering is increased, for thereby improving the wetting to the primary phase. Then $R\text{—}O_{1-x}\text{—}F_{1+2x}$ and $R\text{—}F_y$ can be distributed in proximity to primary phase crystal grains so as to enclose the grains. Additionally, $R\text{—}O_{1-x}\text{—}F_{1+2x}$ and $R\text{—}F_y$ are more wettable to primary phase crystal grains because of a lower melting point than rare earth oxides. As a result, the resistivity of the overall sintered body can be increased. Moreover, heat treatment following sintering is expected to achieve further improvements in magnetic properties through inter-diffusion of rare earth elements between the primary phase $R_2T_{14}B$ and the fluoride $R\text{—}O_{1-x}\text{—}F_{1+2x}$ and $R\text{—}F_y$.

In the sintered magnet of the invention, the $R\text{—}O_{1-x}\text{—}F_{1+2x}$ wherein x is an arbitrary real number of 0 to 1 or $R\text{—}F_y$ wherein y is 2 or 3 preferably has a particle size of 0.1 to 50 μm, especially 1.0 to 40 μm. A particle size of less than 0.1 μm may be less effective whereas a particle size of more than 50 μm may interfere with densification.

It is noted that R is a magnet constituent element selected from among Ce, Pr, Nd, Tb, and Dy. If fluorides of alkali and alkaline earth metals and fluorides of rare earth elements other than the foregoing are used, magnetic properties are deteriorated.

The fine dispersion of $R\text{—}O_{1-x}\text{—}F_{1+2x}$ or $R\text{—}F_y$ particles within the sintered body ensures to make relatively high the temperature coefficient of resistivity in a temperature region equal to or lower than the Curie point and the specific heat. This is probably because the resistivity and specific heat of $R\text{—}O_{1-x}\text{—}F_{1+2x}$ or $R\text{—}F_y$ powder are higher than those of $R_2Fe_{14}B$ compound. It is our own discovery that the addition of $R\text{—}O_{1-x}\text{—}F_{1+2x}$ or $R\text{—}F_y$ powder increases the temperature coefficient of resistivity.

Often, the magnet has a resistivity of at least $2.0\times10^2$ μΩ-cm at 20° C., preferably at least $5.0\times10^2$ μΩ-cm at 20° C. The magnet has a temperature coefficient of resistivity of at least $5.0\times10^{-2}$ μΩ-cm/° C., preferably at least $6.5\times10^{-2}$ μΩ-cm/° C. in a temperature region equal to or lower than the Curie point. It is noted that the resistivity of a magnet is measured by the four-terminal method.

The magnet has a specific heat of at least 400 J/kg-K, preferably at least 450 J/kg-K.

The Joule heat generated in a magnet by eddy current flow is given by the following equation.

$$P = K\frac{\pi^2}{8\rho(T)}\frac{a^2b^2}{a^2+b^2}VB^2f^2 \qquad \text{eq. 1}$$

P: heat value (W)
a: magnet width (m)
b: magnet breadth (m)
ρ: resistivity (Ω-m)
V: magnet volume ($m^3$)
B: alternating magnetic field peak value (T)
f: alternating magnetic field frequency (Hz)
K: shape constant Since the Joule heat is in inverse proportion to the resistivity of the magnet, the Joule heat by eddy current flow can be reduced by increasing the resistivity at room temperature and the temperature coefficient of resistivity at a temperature equal to or lower than the Curie point. When the Joule heat is reflected by a temperature rise of the magnet, it is given by the following equation.

$$P = c\cdot m\cdot\frac{dT}{dt} \qquad \text{eq. 2}$$

P: heat value (W)
c: specific heat (W-sec/(kg-K))
m: magnet weight (kg)
dT/dt: magnet temperature rise rate (K/sec)

This suggests that increasing the specific heat can hold down the temperature rise rate of the magnet, thereby reducing the temperature rise of the magnet.

It is now described how to prepare the R-T-B—C sintered magnet. Briefly stated, the sintered magnet is prepared by mixing (I) an R-T-B—C primary phase alloy powder (or R-T-B—C magnet matrix alloy),
(II) an R-rich R-T-B—C sintering aid alloy, and
(III) an $R\text{—}O_{1-x}\text{—}F_{1+2x}$ and/or $R\text{—}F_y$ powder, pulverizing the mixture through a jet mill in a nitrogen stream, compacting the mixture in a magnetic field into a compact, sintering and heat treating the compact. As noted above, R is at least one rare earth element selected from among Ce, Pr, Nd, Tb, and Dy, T is iron or a mixture of iron and at least one other transition metal, typically cobalt, B is boron, C is carbon, x is an arbitrary real number of 0 to 1, and y is 2 or 3.

It is recommended to add the $R\text{—}O_{1-x}\text{—}F_{1+2x}$ or $R\text{—}F_y$ powder (III) to the R-T-B—C magnet matrix alloy (I) together with the R-rich R-T-B—C sintering aid alloy (II) prior to the pulverization step. By effecting pulverization on the fluoride powder at the same time as the magnet matrix alloy and the sintering aid alloy powder, the magnet matrix alloy and the $R\text{—}O_{1-x}\text{—}F_{1+2x}$ or $R\text{—}F_y$ powder are intimately mixed so that fine particles of the magnet matrix alloy as pulverized are coated on the surface with fine particles of $R\text{—}O_{1-x}\text{—}F_{1+2x}$ or $R\text{—}F_y$. It is also possible to control the particle size during the pulverization step. This procedure ensures that the $R\text{—}O_{1-x}\text{—}F_{1+2x}$ or $R\text{—}F_y$ phase is finely dispersed within the sintered body. As a result, resistivity can be increased without detracting from magnetic properties. If the $R\text{—}O_{1-x}\text{—}F_{1+2x}$ or R—$F_y$ powder is added to the magnet matrix alloy powder after the magnet matrix alloy has been pulverized, there is a likelihood that the R—$O_{1-x}$—$F_{1+2x}$ or R—$F_y$ powder is insufficiently mixed with the magnet matrix alloy powder, that is, the R—$O_{1-x}$—$F_{1+2x}$ or R—$F_y$ powder is distributed in a mottle pattern, resulting in undesirably uneven magnetic properties and resistivity.

In the R—$O_{1-x}$—$F_{1+2x}$ or R—$F_y$ powder, R is a magnet constituent element selected from among Ce, Pr, Nd, Tb, and Dy. If fluorides of alkali and alkaline earth metals and fluorides of rare earth elements other than the foregoing are used, they interfere with densification by sintering, resulting in deteriorated magnetic properties.

The amount of the R—$O_{1-x}$—$F_{1+2x}$ or R—$F_y$ powder added is 10 to 50% by weight, and preferably 10 to 30% by weight. If the amount is more than 50% by weight, a density cannot be increased by ordinary vacuum sintering, and instead, special sintering such as a hot isostatic press (HIP) must be employed. Amounts of less than 10% by weight are ineffective for increasing resistivity.

The R—$O_{1-x}$—$F_{1+2x}$ or R—$F_y$ powder, when added, may have a particle size of up to 50 μm, preferably up to 30 μm, and more preferably up to 15 μm. By the pulverization, the same powder may be finely divided to an average particle size of up to 3 μm, preferably up to 1 μm. The above procedure ensures that the R—$O_{1-x}$—$F_{1+2x}$ or R—$F_y$ phase is finely dispersed within the sintered body, whereby the resistivity at room temperature of the sintered body is increased.

In the method of the invention, the R-rich R-T-B—C sintering aid alloy (II) which consists essentially of 50 wt %≦R≦65 wt %, 0.3 wt %≦B≦0.9 wt %, 0.01 wt %≦C≦0.5 wt %, 0.1 wt %≦Al≦1.0 wt %, 0.1 wt %≦Cu≦5.0 wt % (preferably 0.1 wt %≦Cu≦1.0 wt %), and the balance of T, is added in an amount of 1 to 20% by weight, preferably 3 to 15% by weight. If the amount is less than 1% by weight, sintering becomes difficult, and a sintered density is not fully increased. If the amount is more than 20% by weight, no satisfactory magnetic properties are available.

The R-T-B—C primary phase alloy powder (I) used herein is a magnet matrix alloy (or magnet-forming alloy) and consists essentially of 25 wt %≦R≦35 wt %, 0.8 wt %≦B≦1.4 wt %, 0.01 wt %≦C≦0.5 wt %, 0.1 wt %≦Al≦1.0 wt %, and the balance of T. It is an alloy containing $R_2$—$Fe_{14}$—(B,C) intermetallic compound as the primary phase. The amount of the alloy powder (I) added is the remainder to sum to 100% with the powders (II) and (III). Preferably the amount of the alloy powder (I) added is 2.3 to 19 times, especially 5.0 to 19 times, on a weight basis, the amount of the R-rich R-T-B—C sintering aid alloy (II).

According to the method of the invention, the R-T-B—C sintered magnet is prepared by mixing of components (I), (II) and (III), pulverization through a jet mill in a nitrogen stream, compaction in a magnetic field, sintering and heat treatment. In one preferred embodiment, the powder mixture is pulverized through a jet mill in a nitrogen stream to an average particle size of 0.01 to 30 μm, more preferably 0.1 to 10 μm, and most preferably 0.5 to 10 μm. The powder as pulverized is then compacted in a magnetic field of 800 to 1,760 kA/m, especially 1,000 to 1,760 kA/m and under a pressure of 90 to 150 MPa, especially 100 to 120 MPa. The compact is sintered in a vacuum atmosphere at a temperature of 1,000 to 1,200° C., and aged in an argon atmosphere at a temperature of 400 to 600° C. In this way, an R-T-B—C sintered magnet is obtained.

The R-T-B—C sintered magnet thus obtained should preferably have the following composition.

| | |
|---|---|
| R = | 25 to 35% by weight |
| B = | 0.8 to 1.4% by weight |
| C = | 0.01 to 0.5% by weight |
| Al = | 0.1 to 1.0% by weight |
| Cu = | 0.1 to 5.0% by weight (especially 0.1 to 1.0% by weight) |
| balance = | T and incidental impurities (O, N, Si, P, S, Cl, Na, K, Mg, Ca, etc.) |

EXAMPLE

Examples of the invention are given below by way of illustration and not by way of limitation.

Examples 1 to 3 & Comparative Example 1

In Examples 1 to 3, an R-T-B—C magnet matrix alloy was prepared by weighing predetermined amounts of Nd of at least 99 wt % purity containing 0.04 wt % C, Dy of at least 99 wt % purity containing 0.04 wt % C, Fe of at least 99 wt % purity, Al, and ferroboron, high-frequency melting in an argon atmosphere, and quenching in an argon atmosphere by a single chill roll technique. The alloy was obtained in thin ribbon form. The R-T-B—C magnet matrix alloy obtained had a composition of 25 wt % Nd, 3 wt % Dy, 0.2 wt % Al, 1 wt % B, 0.01 wt % C, and the balance of Fe. The alloy ribbon thus prepared was then crushed by hydriding. The hydriding disintegration included hydriding at room temperature for 2 hours and heat treatment in vacuum at 600° C. for 2 hours for dehydriding.

An R-T-B—C sintering aid alloy was prepared by weighing predetermined amounts of Nd of at least 99 wt % purity containing 0.04 wt % C, Dy of at least 99 wt % purity containing 0.04 wt % C, Fe of at least 99 wt % purity, Co, Cu, Al, and ferroboron, and high-frequency melting in an argon atmosphere. The R-T-B—C sintering aid alloy obtained had a composition of 45 wt % Nd, 13 wt % Dy, 0.2 wt % Al, 0.5 wt % B, 20 wt % Co, 1.2 wt % Cu, 0.02 wt % C, and the balance of Fe.

The R-T-B—C magnet matrix alloy and the R-T-B—C sintering aid alloy were mixed in a weight ratio of 85:15 to form a powder mix. The powder mix and $NdF_3$ were weighed in a weight ratio of 9:1, 8:2 or 1:1, mixed in a V-mixer, and pulverized through a jet mill in $N_2$ gas. The resulting fine powder had an average particle size of 3 to 6 μm.

The fine powder was filled in a mold of a compacting machine where it was oriented in a magnetic field of 955 kA/m and compacted under a pressure of 98.1 MPa in a perpendicular direction to the magnetic field. The compact thus obtained was sintered at 1,050° C. for 2 hours in a vacuum atmosphere, cooled, and heat treated at 500° C. for one hour in an argon atmosphere. In this way, permanent magnet materials of different composition were prepared.

Comparative Example 1 was prepared by the same procedure as above, aside from omitting $NdF_3$.

The sintered magnets were measured for magnetic properties, specific heat, resistivity (by the four-terminal method), and temperature coefficient of resistivity from room temperature to around the Curie point. The results are shown in Table 1.

TABLE 1

| | Sintering aid amount (wt %) | Additive | Additive amount (wt %) | Addition stage | Density (g/cm$^3$) | Br (T) | iHc (kA/m) | Squareness ratio | Specific heat (J/kg – K) | Resistivity (μΩ – cm) | Temperature coefficient (μΩ – cm/° C.) |
|---|---|---|---|---|---|---|---|---|---|---|---|
| Example 1 | 13.5 | $NdF_3$ | 10 | prior to pulverization | 7.52 | 1.15 | 1864 | 0.98 | 550 | $2.0 \times 10^2$ | $5.4 \times 10^{-2}$ |
| Example 2 | 12.0 | $NdF_3$ | 20 | prior to pulverization | 7.41 | 1.03 | 1920 | 0.98 | 630 | $3.6 \times 10^2$ | $1.3 \times 10^{-1}$ |
| Example 3 | 7.5 | $NdF_3$ | 50 | prior to pulverization | 6.65 | 0.54 | 1943 | 0.94 | 700 | $5.2 \times 10^2$ | $2.9 \times 10^{-1}$ |
| Comparative Example 1 | 15 | — | — | prior to pulverization | 7.60 | 1.25 | 1750 | 0.98 | 460 | $1.4 \times 10^2$ | $4.5 \times 10^{-2}$ |

It is seen from Table 1 that in the magnets having $NdF_3$ added, as the amount of $NdF_3$ added increases, the remanence (Br) decreases, and the coercive force (iHc) remains substantially unchanged or increases in some cases, in comparison with the $NdF_3$-free magnet. Resistivity increases in proportion to the increasing amount of $NdF_3$, and its temperature coefficient also increases.

Figure 2:
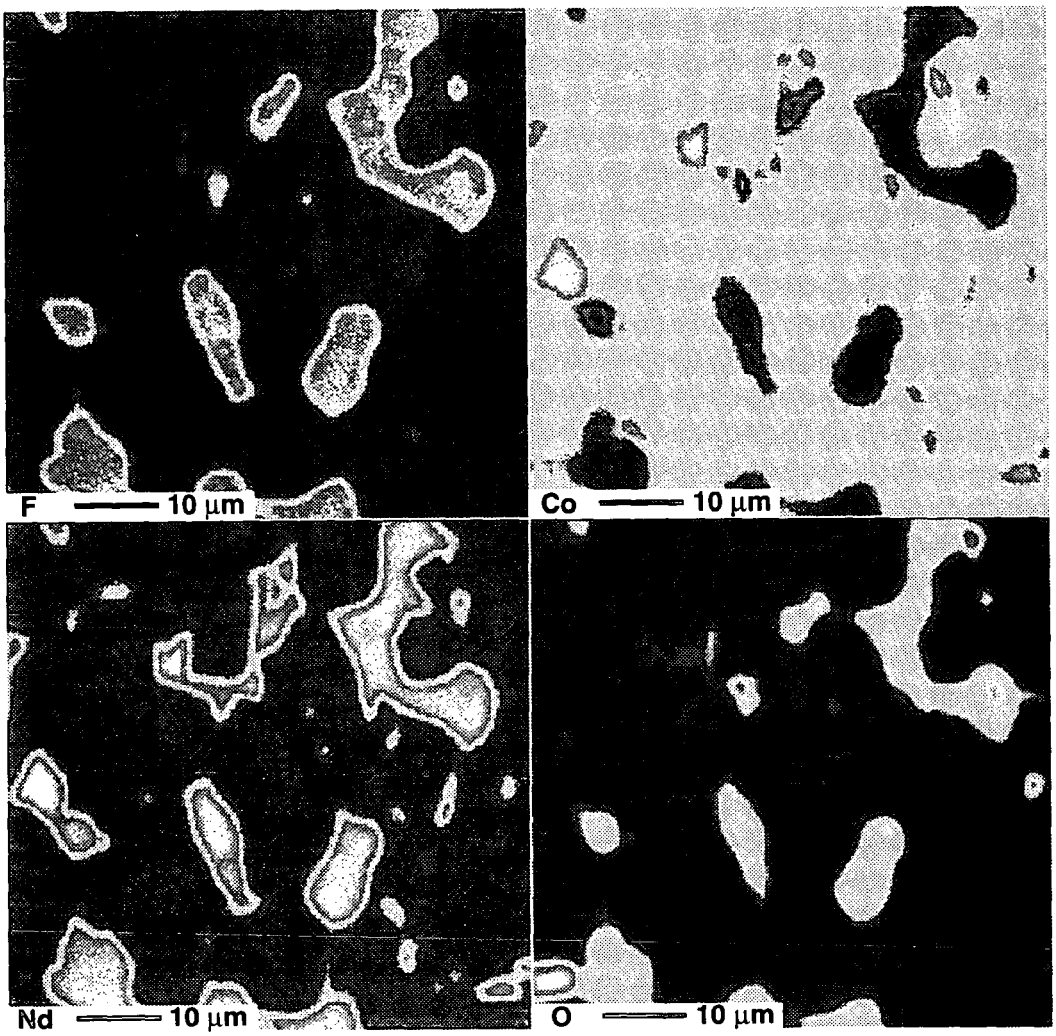
FIG. 2 illustrates back-scattered electron and MAP images of the permanent magnet material of Example 1 observed by EPMA.

FIGS. 1 and 2 illustrate back-scattered electron images and MAP images of magnets observed by electron probe microanalysis (EPMA). FIG. 1 shows the structure of $NdF_3$-free magnet, and FIG. 2 shows the structure of the magnet with 10 wt % $NdF_3$ added. It is seen from the images of the $NdF_3$-added magnet that the grain boundary is composed of R-rich phase, NdOF, $NdF_3$, and Nd—(O,C,O—C). NdOF had a particle size (length) of about 5 to 35 μm, as measured in the images. The R-T phase and B rich phase had a particle size (length) of about 0.5 to 10 μm, as measured in the back-scattered electron images.

Table 2 shows the volume fractions of respective phases, as determined from the MAP image.

TABLE 2

| | Nd—O—F | $NdF_3$ | Nd-(0, C, 0-C) | Nd rich phase | R-T phase | B rich phase |
|---|---|---|---|---|---|---|
| Example 1 | 34.7 | 9.5 | 9.0 | 37.1 | 3.0 | 6.5 |
| Example 2 | 27.4 | 23.5 | 6.2 | 34.0 | 2.8 | 5.9 |
| Example 3 | 4.6 | 56.4 | 4.8 | 27.2 | 2.2 | 4.7 |
| Comparative Example 1 | 0.0 | 0.0 | 48.4 | 40.9 | 3.3 | 7.1 |

Each magnet block obtained by the above procedure was worked into a shape of 50 mm×50 mm×10 mm (thick), and the magnet wrapped in a thermal insulating materials was placed in a coil. An alternating magnetic field with a strength of 8.656 kA/m was applied to the magnet at a frequency of 2 kHz. Using a thermocouple attached to the magnet, a temperature rise per unit time of the magnet was measured. From a gradient (dT/dt) of the temperature rise, a heat value generated was calculated according to eq. 2. The results are shown in Table 3. It is seen from Table 3 that the amount of $NdF_3$ added and the heat value are in inverse proportion, confirming a reduction of loss due to $NdF_3$ addition.

TABLE 3

| Example | Heat value (W) |
|---|---|
| Example 1 | 15.5 |
| Example 2 | 8.9 |
| Example 3 | 3.6 |
| Comparative Example 1 | 17.6 |

Examples 4 to 6

The R-T-B—C magnet matrix alloy and the R-T-B—C sintering aid alloy, both prepared in Examples 1 to 3, were mixed in a weight ratio of 89:11 to form a powder mix. The powder mix and $NdF_3$ were weighed in a weight ratio of 95:5, 85:15 or 65:35, mixed in a V-mixer, and pulverized through a jet mill in a nitrogen stream. The resulting fine powder had an average particle size of about 4.8 μm. The fine powder was filled in a mold of a compacting machine where it was oriented in a magnetic field of 955 kA/m and compacted under a pressure of 98.1 MPa in a perpendicular direction to the magnetic field. The compact thus obtained was sintered at 1,050° C. for 2 hours in a vacuum atmosphere, cooled, and heat treated at 500° C. for one hour in an argon atmosphere. In this way, permanent magnet materials of different composition were prepared.

The sintered magnets were measured for magnetic properties, specific heat, resistivity (by the four-terminal method), and temperature coefficient of resistivity from room temperature to around the Curie point. The results are shown in Table 4.

TABLE 4

| | Sintering aid amount (wt %) | Additive | Additive amount (wt %) | Addition stage | Density (g/cm$^3$) | Br (T) | iHc (kA/m) | Squareness ratio | Specific heat (J/kg – K) | Resistivity (μΩ – cm) | Temperature coefficient (μΩ – cm/° C.) |
|---|---|---|---|---|---|---|---|---|---|---|---|
| Example 4 | 10.5 | $NdF_3$ | 5 | prior to pulverization | 7.58 | 1.33 | 1527 | 0.98 | 530 | $1.8 \times 10^2$ | $5.1 \times 10^{-2}$ |
| Example 5 | 9.4 | $NdF_3$ | 15 | prior to pulverization | 7.44 | 1.30 | 1663 | 0.95 | 600 | $3.2 \times 10^2$ | $8.5 \times 10^{-2}$ |
| Example 6 | 7.2 | $NdF_3$ | 35 | prior to pulverization | 6.68 | 0.54 | 1588 | 0.96 | 650 | $4.1 \times 10^2$ | $1.3 \times 10^{-1}$ |

It is seen from Table 4 that as the amount of $NdF_3$ added increases, the remanence (Br) decreases, and the coercive force (iHc) remains substantially unchanged, in comparison with $NdF_3$-free magnets. Increases of specific heat, resistivity and temperature coefficient thereof are also demonstrated.

Examples 7 to 9

In Examples 7 to 9, an R-T-B—C magnet matrix alloy was prepared by weighing predetermined amounts of Nd of at least 99 wt % purity containing 0.04 wt % C, Dy of at least 99 wt % purity containing 0.04 wt % C, Fe of at least 99 wt % purity, Al, and ferroboron, high-frequency melting in an argon atmosphere, and quenching in an argon atmosphere by a single chill roll technique. The alloy was obtained in thin ribbon form. The R-T-B—C magnet matrix alloy obtained had a composition of 25 wt % Nd, 3 wt % Dy, 0.2 wt % Al, 1 wt % B, 0.01 wt % C, and the balance of Fe. The alloy ribbon thus prepared was then crushed by hydriding. The hydriding disintegration included hydriding at room temperature for 2 hours and heat treatment in vacuum at 600° C. for 2 hours for dehydriding.

An R-T-B—C sintering aid alloy was prepared by weighing predetermined amounts of Nd of at least 99 wt % purity containing 0.04 wt % C, Dy of at least 99 wt % purity containing 0.04 wt % C, Fe of at least 99 wt % purity, Co, Cu, Al, and ferroboron, and high-frequency melting in an argon atmosphere. The R-T-B—C sintering aid alloy obtained had a composition of 45 wt % Nd, 13 wt % Dy, 0.2 wt % Al, 0.5 wt % B, 20 wt % Co, 1.2 wt % Cu, 0.02 wt % C, and the balance of Fe.

The R-T-B—C magnet matrix alloy and the R-T-B—C sintering aid alloy were mixed in a weight ratio of 85:15 to form a powder mix. The powder mix and $DyF_3$, $NdF_3$+$DyF_3$ ($NdF_3/DyF_3$=1/1 in weight ratio) or NdOF were weighed in a weight ratio of 8:2, mixed in a V-mixer, and pulverized through a jet mill in $N_2$ gas. The resulting fine powder had an average particle size of 2.5 to 5.6 μm.

The fine powder was filled in a mold of a compacting machine where it was oriented in a magnetic field of 955 kA/m and compacted under a pressure of 98.1 MPa in a perpendicular direction to the magnetic field. The compact thus obtained was sintered at 1,050° C. for 2 hours in a vacuum atmosphere, cooled, and heat treated at 500° C. for one hour in an argon atmosphere. In this way, permanent magnet materials of different composition were prepared. Thereafter, as in the foregoing Examples, magnet samples were prepared for physical property measurement and evaluation.

Table 5 shows the magnetic properties and specific heat of the sintered magnets as well as resistivity (by the four-terminal method) and temperature coefficient of resistivity from room temperature to around the Curie point. Table 6 shows the volume fractions of respective phases. Table 7 shows the heat values.

TABLE 6

| | R—O—F | $RF_3$ | R-(0, C, 0-C) | R rich phase | R-T phase | B rich phase |
|---|---|---|---|---|---|---|
| Example 7 | 33.3 | 21.2 | 4.8 | 32.3 | 2.6 | 5.6 |
| Example 8 | 29.7 | 22.8 | 7.7 | 31.7 | 2.6 | 5.5 |
| Example 9 | 45.5 | 2.3 | 8.3 | 34.9 | 2.8 | 6.1 |

TABLE 7

| Example | Heat value (W) |
|---|---|
| Example 7 | 9.2 |
| Example 8 | 7.5 |
| Example 9 | 8.4 |

Examples 10 to 12

In Examples 10 to 12, an R-T-B—C magnet matrix alloy was prepared by weighing predetermined amounts of Nd of at least 99 wt % purity containing 0.08 wt % C, Dy of at least 99 wt % purity containing 0.12 wt % C, Fe of at least 99 wt % purity, Al, and ferroboron, high-frequency melting in an argon atmosphere, and quenching in an argon atmosphere by a single chill roll technique. The alloy was obtained in thin ribbon form. The R-T-B—C magnet matrix alloy obtained had a composition of 25 wt % Nd, 3 wt % Dy, 0.2 wt % Al, 1 wt % B, 0.02 wt % C, and the balance of Fe. The alloy ribbon thus prepared was then crushed by hydriding. The hydriding disintegration included hydriding at room temperature for 2 hours and heat treatment in vacuum at 600° C. for 2 hours for dehydriding.

An R-T-B—C sintering aid alloy was prepared by weighing predetermined amounts of Nd of at least 99 wt % purity containing 0.06 wt % C, Dy of at least 99 wt % purity containing 0.10 wt % C, Fe of at least 99 wt % purity, Co, Cu, Al, and ferroboron, and high-frequency melting in an argon atmosphere. The R-T-B—C sintering aid alloy obtained had a composition of 45 wt % Nd, 13 wt % Dy, 0.2 wt % Al, 0.5 wt % B, 20 wt % Co, 1.2 wt % Cu, 0.03 wt % C, and the balance of Fe.

The R-T-B—C magnet matrix alloy and the R-T-B—C sintering aid alloy were mixed in a weight ratio of 89:11 to form a powder mix. The powder mix and $DyF_3$, $NdF_3$+$DyF_3$ ($NdF_3/DyF_3$=1/1 in weight ratio) or NdOF were weighed in a weight ratio of 85:15, mixed in a V-mixer, and pulverized through a jet mill in $N_2$ gas. The resulting fine powder had an average particle size of 3.0 to 4.8 μm.

The fine powder was filled in a mold of a compacting machine where it was oriented in a magnetic field of 955 kA/m and compacted under a pressure of 98.1 MPa in a

TABLE 5

| | Sintering aid amount (wt %) | Additive | Additive amount (wt %) | Addition stage | Density (g/cm$^3$) | Br (T) | iHc (kA/m) | Squareness ratio | Specific heat (J/kg – K) | Resistivity (μΩ – cm) | Temperature coefficient (μΩ – cm/° C.) |
|---|---|---|---|---|---|---|---|---|---|---|---|
| Example 7 | 12.0 | $DyF_3$ | 20 | prior to pulverization | 7.50 | 0.85 | 3120 | 0.97 | 620 | $3.6 \times 10^2$ | $1.2 \times 10^{-1}$ |
| Example 8 | 12.0 | $NdF_3$ + $DyF_3$ | 20 | prior to pulverization | 7.29 | 0.99 | 2492 | 0.98 | 630 | $3.1 \times 10^2$ | $1.3 \times 10^{-1}$ |
| Example 9 | 12.0 | NdOF | 20 | prior to pulverization | 7.47 | 1.01 | 1803 | 0.95 | 620 | $3.5 \times 10^2$ | $1.3 \times 10^{-1}$ |

perpendicular direction to the magnetic field. The compact thus obtained was sintered at 1,050° C. for 2 hours in a vacuum atmosphere, cooled, and heat treated at 500° C. for one hour in an argon atmosphere. In this way, permanent magnet materials of different composition were prepared.

Table 8 shows the magnetic properties and specific heat of the sintered magnets as well as resistivity (by the four-terminal method) and temperature coefficient of resistivity from room temperature to around the Curie point.

TABLE 8

| | Sintering aid amount (wt %) | Additive | Additive amount (wt %) | Addition stage | Density (g/cm$^3$) | Br (T) | iHc (kA/m) | Squareness ratio | Specific heat (J/kg – K) | Resistivity (μΩ – cm) | Temperature coefficient (μΩ – cm/° C.) |
|---|---|---|---|---|---|---|---|---|---|---|---|
| Example 10 | 9.4 | $DyF_3$ | 15 | prior to pulverization | 7.48 | 1.31 | 1814 | 0.97 | 610 | $2.9 \times 10^2$ | $7.9 \times 10^{-2}$ |
| Example 11 | 9.4 | $NdF_3$ + $DyF_3$ | 15 | prior to pulverization | 7.49 | 1.31 | 1739 | 0.96 | 600 | $3.1 \times 10^2$ | $8.5 \times 10^{-2}$ |
| Example 12 | 9.4 | NdOF | 15 | prior to pulverization | 7.48 | 1.31 | 1633 | 0.97 | 600 | $3.2 \times 10^2$ | $8.3 \times 10^{-2}$ |

It is seen from Table 8 that addition of $DyF_3$ results in an increase of coercive force (iHc). An increase of resistivity is also demonstrated.

Comparative Examples 2 and 3

An R-T-B—C magnet matrix alloy was prepared by weighing predetermined amounts of Nd of at least 99 wt % purity containing 0.04 wt % C, Dy of at least 99 wt % purity containing 0.04 wt % C, Fe of at least 99 wt % purity, Al, and ferroboron, high-frequency melting in an argon atmosphere, and quenching in an argon atmosphere by a single chill roll technique. The alloy was obtained in thin ribbon form. The R-T-B—C magnet matrix alloy obtained had a composition of 25 wt % Nd, 3 wt % Dy, 0.2 wt % Al, 1 wt % B, 0.01 wt % C, and the balance of Fe. The alloy ribbon thus prepared was then crushed by hydriding. The hydriding disintegration included hydriding at room temperature for 2 hours and heat treatment in vacuum at 600° C. for 2 hours for dehydriding.

An R-T-B—C sintering aid alloy was prepared by weighing predetermined amounts of Nd of at least 99 wt % purity containing 0.04 wt % C, Dy of at least 99 wt % purity containing 0.04 wt % C, Fe of at least 99 wt % purity, Co, Cu, Al, and ferroboron, and high-frequency melting in an argon atmosphere. The R-T-B—C sintering aid alloy obtained had a composition of 45 wt % Nd, 13 wt % Dy, 0.2 wt % Al, 0.5 wt % B, 20 wt % Co, 1.2 wt % Cu, 0.02 wt % C, and the balance of Fe.

The R-T-B—C magnet matrix alloy and the R-T-B—C sintering aid alloy were mixed in a weight ratio of 85:15 to form a powder mix. The powder mix and LiF or $CaF_2$ were weighed in a weight ratio of 9:1, mixed in a V-mixer, and pulverized through a jet mill in $N_2$ gas.

Subsequently sintered magnets were prepared as in the foregoing Examples and measured for physical properties and evaluated. Table 9 shows the magnetic properties of the sintered magnets. The sintered magnets were found to be unevenly sintered and have little coercive force (iHc).

TABLE 9

| | Sintering aid amount (wt %) | Additive | Additive amount (wt %) | Addition stage | Density (g/cm$^3$) | Br (T) | iHc (kA/m) | Squareness ratio |
|---|---|---|---|---|---|---|---|---|
| Comparative Example 2 | 13.5 | LiF | 10 | prior to pulverization | 7.49 | 0.90 | 17 | 0.07 |
| Comparative Example 3 | 13.5 | $CaF_2$ | 10 | prior to pulverization | 7.23 | 0.84 | 18 | 0.07 |

Comparative Examples 4 to 7

The R-T-B—C magnet matrix alloy and the R-T-B—C sintering aid alloy, both prepared in Comparative Example 2, were weighed in a weight ratio of 89:11, mixed in a V-mixer, and pulverized through a jet mill in $N_2$ gas. The resulting fine powder had an average particle size of 5.0 μm. The fine powder mix and $DyF_3$, $CaF_2$, $Nd_2O_3$ or $Dy_2O_3$ were weighed in a weight ratio of 90:10 or 80:20, and mixed for 20 minutes in a V-mixer. The powder as mixed revealed that agglomerates of fluoride powder were locally distributed.

The fine powder was filled in a mold of a compacting machine where it was oriented in a magnetic field of 955 kA/m and compacted under a pressure of 98.1 MPa in a perpendicular direction to the magnetic field. The compact thus obtained was sintered at 1,050° C. for 2 hours in a vacuum atmosphere, cooled, and heat treated at 500° C. for one hour in an argon atmosphere. In this way, permanent magnet materials of different composition were prepared (Comparative Examples 4 to 7).

Table 10 shows the magnetic properties of the sintered magnets as well as resistivity (by the four-terminal method). It is seen from Table 10 that the procedure of Comparative Examples increases resistivity at the expense of magnetic properties.

TABLE 10

| | Sintering aid amount (wt %) | Additive | Additive amount (wt %) | Addition stage | Density (g/cm$^3$) | Br (T) | iHc (kA/m) | Squareness ratio | Resistivity (μΩ – cm) |
|---|---|---|---|---|---|---|---|---|---|
| Comparative Example 4 | 8.8 | $NdF_3$ | 20 | after pulverization | 7.13 | 0.88 | 2015 | 0.89 | $3.0 \times 10^2$ |
| Comparative Example 5 | 8.8 | $CaF_2$ | 20 | after pulverization | 7.21 | 0.89 | 162 | 0.41 | $4.4 \times 10^2$ |
| Comparative Example 6 | 9.9 | $Nd_2O_3$ | 10 | after pulverization | 7.05 | 0.84 | 1198 | 0.80 | $4.9 \times 10^2$ |
| Comparative Example 7 | 9.9 | $Dy_2O_3$ | 10 | after pulverization | 6.99 | 0.83 | 198 | 0.39 | $4.5 \times 10^2$ |

Japanese Patent Application Nos. 2005-349185 and 2005-349192 are incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. An R-T-B-C rare earth sintered magnet wherein R is at least one rare earth element selected from the group consisting of Ce, Pr, Nd, Tb, and Dy, T is iron or a mixture of iron and at least one other transition metal, B is boron, and C is carbon, which magnet is obtained by:

mixing (II) 1 to 20% by weight of an R-rich R-T-B—C sintering aid alloy consisting essentially of 50 wt %≦R≦65 wt %, 0.3 wt %≦B≦0.9 wt %, 0.01 wt %≦C≦0.5 wt %, 0.1 wt %≦Al≦1.0 wt %. 0.1 wt %≦Cu≦5.0 wt %, and the balance of T, (III) 10 to 50% by weight of an R—$O_{1-x}$—$F_{1+2x}$ and/or R—$F_y$ powder having an average particle size of 0.5 to 50μm wherein x is an arbitrary real number of 0 to 1 and y is 2 or 3, and (I) the remainder of a R-T-B—C primary phase magnet matrix alloy powder consisting essentially of 25 wt %≦R≦35 wt %, 0.8 wt %≦B≦1.4 wt %, 0.01 wt %≦C≦0.5 wt %, 0.1 wt %≦Al≦1.0 wt %, and the balance of T, pulverizing the mixture through a jet mill in a nitrogen stream to an average particle size of 0.01 to 30 μm, compacting the mixture in a magnetic field into a compact, sintering and heat treating the compact, wherein the rare earth sintered magnet has a sintered structure consisting of an $R_2T_{14}B$ structure crystal primary phase and a grain boundary phase, said grain boundary phase consisting essentially of 40 to 98% by volume (a volume fraction in the grain boundary phase) of R-$O_{1-x}$-$F_{1+2x}$ and/or R-$F_y$ wherein x is an arbitrary real number of 0 to 1 and y is 2 or 3, 1 to 50% by volume of a compound phase selected from R-O, R-O-C, and R-C compounds, and mixtures thereof, 0.05 to 10% by volume of a R-T phase, 0.05 to 20% by volume of a B-rich phase ($R_{1+\epsilon}Fe_4B_4$) or M-$B_2$ phase wherein M is at least one element selected from the group consisting of Ti, V, Cr, Zr, Nb, Mo, Hf, Ta and W, and the balance of an R-rich phase.

2. The R-T-B—C rare earth sintered magnet of claim 1, wherein in the grain boundary phase, the R—$O_{1-x}$—$F_{1+2x}$ or R—$F_y$ has a particle size of 0.1 to 50 μm, the compound phase, the R-T phase, and the B-rich phase or M-$B_2$ phase each have a particle size of 0.05 to 20 μm.

3. The R-T-B—C rare earth sintered magnet of claim 1, having a resistivity of at least $2.0\times10^2$ μΩ-cm at 20° C.

4. The R-T-B—C rare earth sintered magnet of claim 1, having a temperature coefficient of resistivity of at least $5.0\times10^{-2}$ μΩ-cm/° C. in a temperature region equal to or lower than the Curie point.

5. The R-T-B—C rare earth sintered magnet of claim 1, having a specific heat of at least 400 J/kg-K.

6. A method for preparing a R-T-B—C sintered magnet wherein R is at least one rare earth element selected from the group consisting of Ce, Pr, Nd, Tb, and Dy, T is iron or a mixture of iron and at least one other transition metal, B is boron, and C is carbon, said method comprising the steps of mixing (II) 1 to 20% by weight of an R-rich R-T-B—C sintering aid alloy consisting essentially of 50 wt %≦R≦65 wt %, 0.3 wt %≦B≦0.9 wt %, 0.01 wt %≦C≦0.5 wt %, 0.1 wt %≦Al≦1.0 wt %, 0.1 wt %≦Cu≦5.0 wt %, and the balance of T, (III) 10 to 50% by weight of an R—$O_{1-x}$—$F_{1+2x}$ and/or R—$F_y$ powder wherein x is an arbitrary real number of 0 to 1 and y is 2 or 3, and (I) the remainder of a R-T-B—C primary phase magnet matrix alloy powder consisting essentially of 25 wt %≦R≦35 wt %, 0.8 wt %≦B≦1.4 wt %, 0.01 wt %≦C≦0.5 wt %, 0.1 wt %≦Al≦1.0 wt %, and the balance of T, pulverizing the mixture through a jet mill in a nitrogen stream, compacting the mixture in a magnetic field into a compact, sintering and heat treating the compact.

7. The method of claim 6, wherein the R—$O_{1-x}$—$F_{1+2x}$ and/or R—$F_y$ powder has an average particle size of 0.5 to 50 μm.

8. The method of claim 6, wherein the pulverizing step includes pulverizing the mixture through a jet mill in a nitrogen stream to an average particle size of 0.01 to 30 μm, the compacting step includes compacting the mixture in a magnetic field of 800 to 1,760 kA/m under a pressure of 90 to 150 MPa, the sintering step includes sintering the compact at 1,000 to 1,200° C. in vacuum, and the heat treating step includes aging treatment at 400 to 600° C. in an argon atmosphere.

9. The R-T-B—C rare earth sintered magnet of claim 1 wherein the amount of the $R—O_{1-x}—F_{1+2x}$ and/or $R—F_y$ powder is 20 to 50% by weight.

* * * * *